United States Patent [19]

Kitagawa et al.

[11] Patent Number: 4,792,749

[45] Date of Patent: Dec. 20, 1988

[54] POWER SOURCE VOLTAGE DETECTOR DEVICE INCORPORATED IN LSI CIRCUIT

[75] Inventors: Nobutaka Kitagawa; Makoto Ito, both of Kawasaki, Japan

[73] Assignee: Kabushiki Kaisha Toshiba, Kawasaki, Japan

[21] Appl. No.: 32,244

[22] Filed: Mar. 31, 1987

[30] Foreign Application Priority Data

Mar. 31, 1986 [JP] Japan ..... 61-71142
Sep. 30, 1986 [JP] Japan ..... 61-231878

[51] Int. Cl.[4] ..... G05F 3/16
[52] U.S. Cl. ..... 323/314; 323/317
[58] Field of Search ..... 323/223, 225, 226, 314–317

[56] References Cited

U.S. PATENT DOCUMENTS

| | | | |
|---|---|---|---|
| 4,260,946 | 4/1981 | Wheatley, Jr. | 323/226 X |
| 4,306,183 | 12/1981 | Wright | 320/39 |
| 4,327,321 | 4/1982 | Suzuki et al. | 323/315 |
| 4,366,432 | 12/1982 | Noro | 323/225 X |
| 4,423,370 | 12/1983 | Wilhelm | 323/315 |
| 4,454,467 | 6/1984 | Sakaguchi | 323/315 X |
| 4,532,467 | 7/1985 | Mensink et al. | 323/314 X |
| 4,593,208 | 6/1986 | Single | 323/316 X |
| 4,638,239 | 1/1987 | Hachinisri | 323/314 X |

FOREIGN PATENT DOCUMENTS

| | | |
|---|---|---|
| 0021289 | 7/1981 | European Pat. Off. . |
| 0121793 | 10/1984 | European Pat. Off. . |
| 2081458 | 2/1982 | United Kingdom . |

OTHER PUBLICATIONS

Horowitz et al., *The Art of Electronics,* (Cambridge University Press, 1980), pp. 246, 420–421.

IC for Precision Reference Power Supply, Transistor Technology, Ferranti Semiconductors, p. 245, Jan. 1987.

C-MOS Voltage Detector and C-MOS Voltage Regulator, Transistor Technology, Seiko Denshi Kogyo Kabushiki Kaisha, p. 324 Jun. 1985.

*Primary Examiner*—Patrick R. Salce
*Assistant Examiner*—Marc S. Hoff
*Attorney, Agent, or Firm*—Finnegan, Henderson, Farabow, Garrett, & Dunner

[57] ABSTRACT

A voltage regulator for an output voltage of a solar cell is formed together with an LSI circuit on a single chip. The voltage regulator includes a bias circuit as a CMOS current mirror circuit consituted by MOS transistors designed to operate in weak inversion regions, a constant current circuit constituted by a parasitic bipolar transistor, a voltage divider having a plurality of MOS transistors whose current paths are connected in series with each other, a comparator constituted by a CMOS differential amplifier, and a current path of a CMOS transistor, thereby assuring low current consumption, a highly stable regulated output, and a high packing density of the LSI circuit.

5 Claims, 15 Drawing Sheets

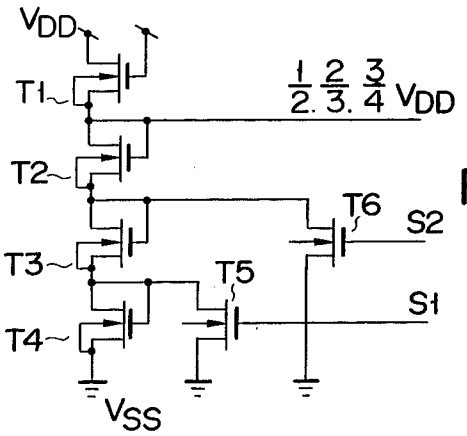
FIG. 15A
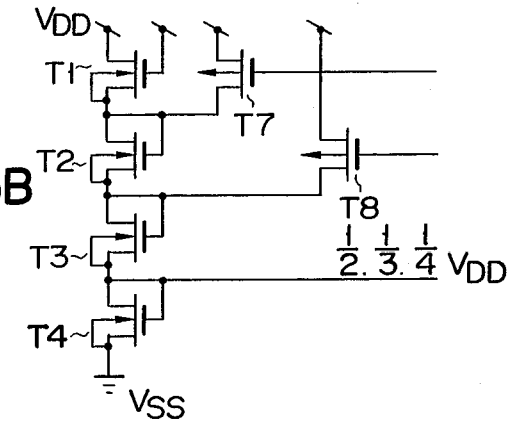
FIG. 15B
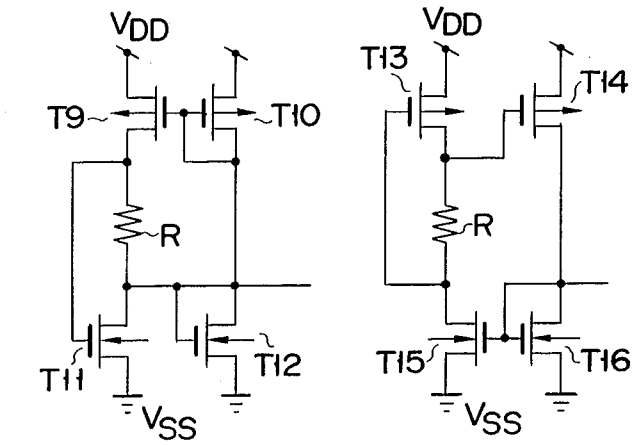
FIG. 16A
FIG. 16B
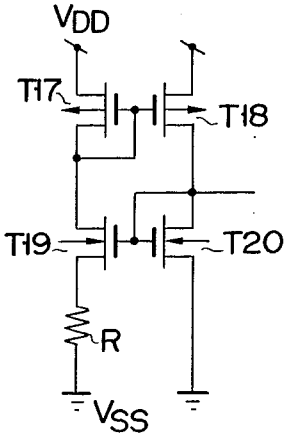
FIG. 16C
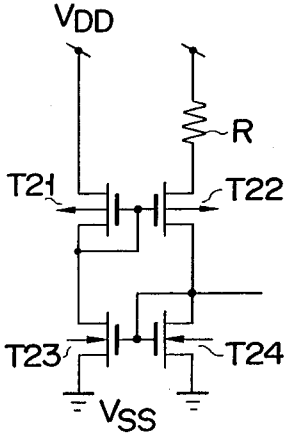
FIG. 16D FIG. 24
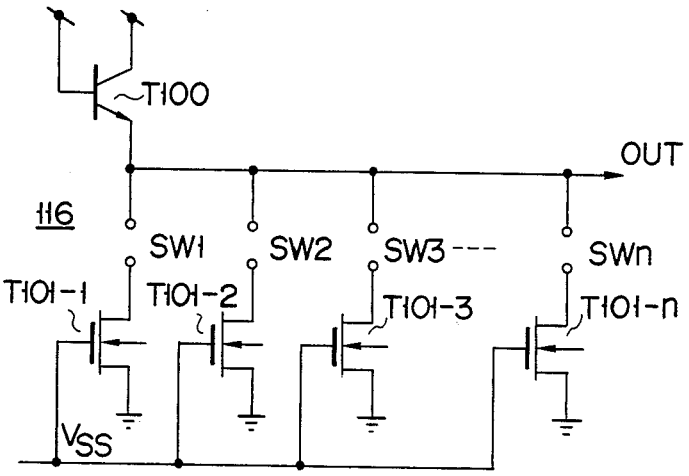
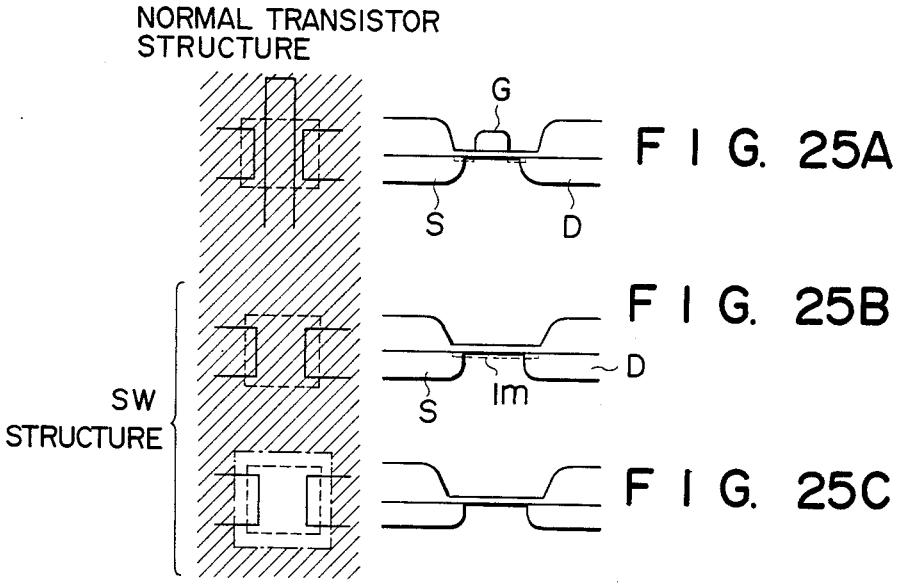
FIG. 25A
FIG. 25B
FIG. 25C

POWER SOURCE VOLTAGE DETECTOR DEVICE INCORPORATED IN LSI CIRCUIT

BACKGROUND OF THE INVENTION

The present invention relates to a semiconductor integrated circuit and, more particularly, to a voltage detector device incorporated in, e.g., an LSI circuit and used together with a voltage regulator of a power source such as a solar cell whose output voltage greatly varies.

When an LSI circuit is driven using a power source such as a solar cell whose output voltage greatly varies, a voltage regulator is an indispensable component. Since a current consumed in the LSI circuit other than the voltage regulator is as small as about 1.5 V, 1,000 nA, a current consumed in the voltage regulator is preferably 200 nA or less. Variations in output voltage of the regulator are preferably ±0.1 V (±7%) or less for 1.5 V. A solar cell voltage regulator is preferably formed in the LSI circuit. Therefore, the occupying area of the voltage regulator on the LSI circuit substrate must be minimized.

A conventional voltage regulator is designed such that at least two series-connected resistors are connected across output terminals of a power source to constitute a voltage divider, an output from the voltage divider is compared with an output voltage from a constant voltage circuit, and a voltage applied to the voltage divider is regulated in response to a comparison output.

In order to form the power source voltage detector device and the voltage regulator having the above-mentioned arrangement in the LSI circuit, current consumption must be limited to 200 nA or less. For this purpose, the resistance of the voltage divider must be as high as several tens of megaohms. However, such a resistance requires a large occupying area in the LSI circuit. It is then impossible to form the voltage regulator on the same substrate or chip of the LSI circuit.

SUMMARY OF THE INVENTION

It is an object of the present invention to provide a power source voltage detector device suitably formed on a single chip, together with an LSI circuit driven by a power source such as a solar cell which has a small output and large output variations, wherein variations in regulated output voltage are small with low current consumption and a small area is required for patterning of the circuit device.

According to the present invention, there is provided a power source detector device to be formed together with an LSI circuit on a single chip, comprising:

bias voltage generating means connected across output terminals of a DC power source and including a current mirror circuit constituted by a plurality of CMOSFETs;

reference voltage generating means including a constant current circuit constituted by at least one MOSFET having a gate applied with the bias voltage supplied from the bias voltage generating means, the reference voltage generating means being connected across the output terminals;

voltage dividing means including a plurality of MOSFETs having current paths connected in series with each other across the output terminals, the voltage dividing means being adapted to divide a voltage across the output terminals; and voltage comparing means including a differential amplifier constituted by a plurality of CMOSFETs, means for applying the reference voltage from the reference voltage generating means to a first input terminal of the differential amplifier, and means for applying a divided voltage from the voltage dividing means to a second input terminal of the differential amplifier;

wherein an output representing the power source voltage of the DC power source is obtained as an output from the comparing means.

BRIEF DESCRIPTION OF THE DRAWINGS

FIGS. 15A and 15B, FIGS. 16A to 16D, FIGS. 17A to 17D, FIGS. 18 and 19, and FIGS. 20A and 20B are circuit diagrams of the component circuits of the embodiment shown in FIG. 14;

FIG. 24 is a circuit diagram showing an application of the reference voltage generator;

FIGS. 25A to 25C are circuit diagrams showing the elements in FIG. 24;

DETAILED DESCRIPTION OF THE PREFERRED EMBODIMENTS

Preferred embodiments of the present invention will be described with reference to the accompanying drawings.

Figure 1:
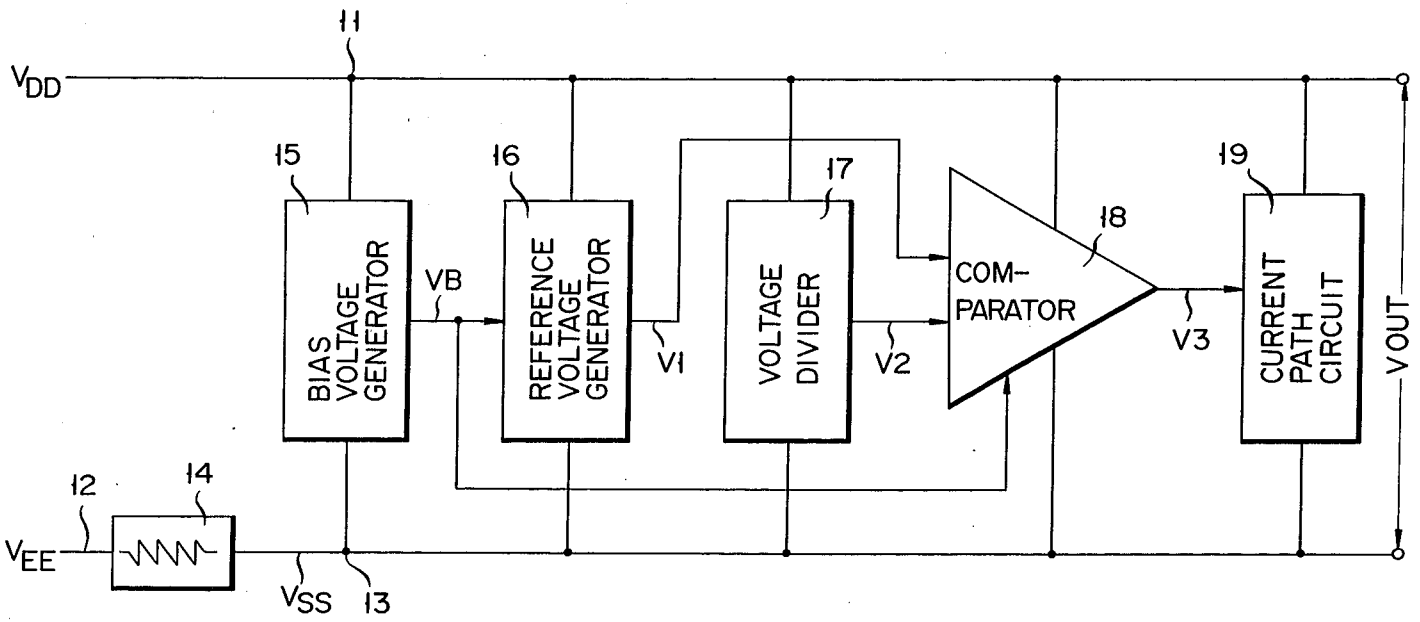
FIG. 1 is a block diagram showing an arrangement according to an embodiment of the present invention.

FIG. 1 is a block diagram showing an arrangement according to an embodiment of the present invention. Referring to FIG. 1, node 11 is applied with voltage VDD of a higher potential of the voltage generated by a solar cell (not shown). Node 12 is applied with voltage VEE of a lower potential of the voltage generated by the solar cell. Resistor 14 is connected between nodes 12 and 13 to regulate an output voltage Vout. Bias voltage generator 15, reference voltage generator 16, voltage divider 17, comparator 18, and current path circuit 19 are connected between nodes 11 and 13.

Bias voltage generator 15 generates a predetermined DC bias voltage VB from a difference between voltage VDD at node 11 and voltage VSS at node 13. Voltage VB is set at a value sufficient to cause a MOS transistor applied with voltage VB to operate in a weak inversion region (described later). Voltage VB generated by generator 15 is supplied to reference voltage generator 16 and comparator 18.

Figure 2:
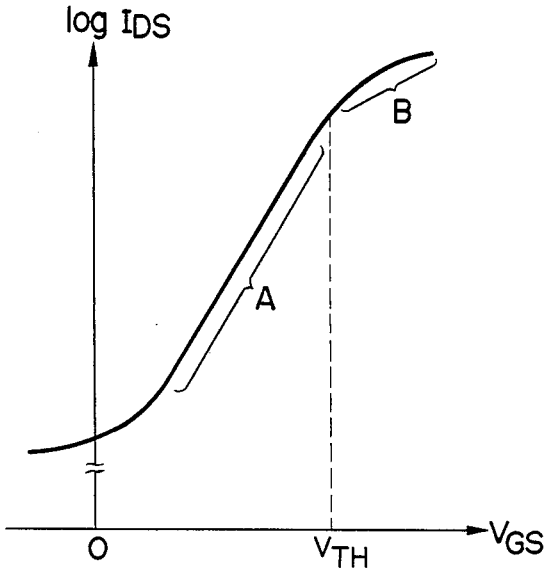
FIG. 2 is a graph showing the characteristics of a conventional MOS transistor.

In this embodiment, in order to reduce a total current consumption of the circuit, the bias voltage VB generated by the bias voltage generating circuit is determined such that each MOS transistor is operated in the weak inversion region of the gate and drain characteristics thereof. The gate voltage (VGS) vs. the drain current (logIDS) characteristics of the MOS transistor are shown in FIG. 2. The characteristics include region A, called the weak inversion region, wherein a current is supplied exponentially in response to a gate bias voltage. The above characteristics also include region B, called a strong inversion region, wherein the current is supplied in proportion to the square of the gate bias voltage. A threshold voltage VTH of the MOS transistor is defined as a voltage at the boundary between regions A and B. When the MOS transistor is operated in region B, a current of several μA is consumed, even if the MOS transistor has a minimum possible size. However, when the MOS transistor is operated in weak inversion region A, current consumption can be reduced to about several tens of nA to several hundreds of nA.

Reference voltage generator 16 generates reference voltage V1, lower by a predetermined potential than voltage VDD with reference to the potential VSS of the node 13, on the basis of bias voltage VB. This voltage V1 is applied to one input of comparator 18.

Voltage divider 17 divides voltage VDD at a predetermined voltage division ratio with respect to the voltage VSS and generates divided voltage V2. Voltage V2 is also applied to the other input of comparator 18.

Comparator 18 compares reference voltage V1 with divided voltage V2 and generates voltage V3 on the basis of the comparison result. Voltage V3 from comparator 18 is applied to current path circuit 19.

Current path circuit 19 supplies a current corresponding to output voltage V3 from comparator 18 to resistor 14 between nodes 12 and 13 to cause a voltage drop across resistor 14, thereby regulating the output voltage Vout so as to be constant.

Figure 3:
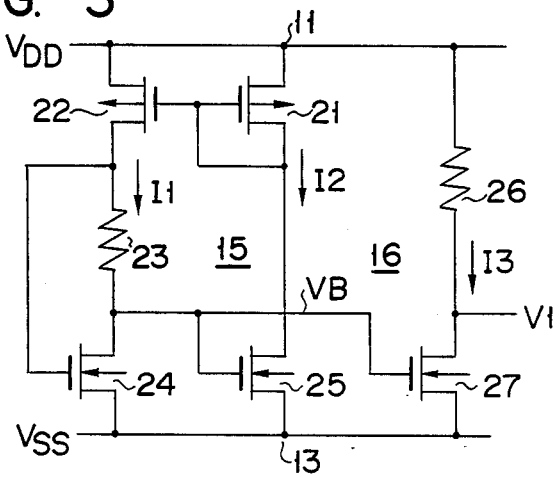
FIGS. 3 to 5 are circuit diagrams showing the detailed arrangements of the circuits in FIG. 1.

FIG. 3 is a circuit diagram showing the detailed arrangement of bias voltage generator 15 and reference voltage generator 16. Generator 15 is arranged as CMOS circuit as follows. The source of p-channel MOS transistor (to be referred to as a p transistor hereinafter) 21 is connected to node 11 applied with voltage VDD. Similarly, the source of p transistor 22 is connected to node 11. The gate and drain of transistor 21 are connected to each other. The gate of transistor 22 is connected to the gate of transistor 21. In other words, transistors 21 and 22 constitute a current mirror circuit in which a current proportional to a current flowing through transistor 21 is supplied to transistor 22.

One terminal of resistor 23 is connected to the drain of p transistor 22. The other terminal of resistor 23 is connected to the drain of n-channel MOS transistor (to be referred to as an n transistor hereinafter) 24. The source of transistor 24 is connected to node 13 applied with voltage VSS. The gate of transistor 24 is connected to one terminal of resistor 23. The drain of transistor 25 is connected to the drain of transistor 21. The source of transistor 25 is connected to node 13, and the gate thereof is connected to the other terminal of resistor 23. Resistor 23 is inserted between the drain and gate of transistor 24. A difference between the gate potentials of transistors 24 and 25 corresponds to a voltage drop across resistor 23. Transistors 24 and 25 constitute a current mirror circuit in which a current proportional to a current flowing through transistor 24 is supplied to transistor 25. Bias voltage VB appears at the other terminal of resistor 23. Bias voltage generator 15 is operated to be stabilized at a single operating point by the self-correction function. A gate voltage of each of transistors 21 and 22 has a value lower than the bias voltage component so as to cause it to operate in the weak inversion region. The gate voltage of each of transistors 24 and 25 has a value higher in bias voltage VB than voltage VSS.

Reference voltage generator 16 is arranged as follows. One terminal of resistor 26 is connected to node 11 applied with voltage VDD. The drain of n transistor 27 is connected to the other terminal of resistor 26. The source of transistor 27 is connected to node 13, and the gate thereof is applied with bias voltage VB generated by bias voltage generator 15. Voltage V1 appears at the common node between resistor 26 and the drain of transistor 27.

Currents I1 and I2, flowing through resistors 23 and 26, are set so that transistors used in circuits 15 and 16 operate in the weak inversion region. The amount of currents I1 and I2 are as small as 20 nA, for example. Therefore, an area on the chip occupied by resistors 23 and 26 is very small.

Figure 4:
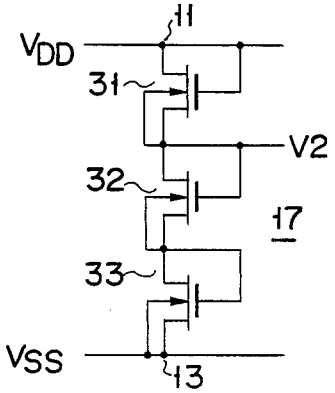

FIG. 4 shows the detailed arrangement of voltage divider 17. Divider 17 is arranged on the same chip substrate as circuits 15 and 16 as follows. The drain and gate of n transistor 31 are connected to node 11 applied with voltage VDD. The back gate (chip substrate) and source of transistor 31 are connected to each other. The connecting point between the back gate and the source of transistor 31 is connected to the drain and gate of n transistor 32. The back gate and source of transistor 32 are connected to each other. The drain and gate of n transistor 33 are connected to the connecting point between the back gate and source of transistor 32. The back gate and source of transistor 33 are connected to node 13 applied with voltage VSS. The sizes of transistors 31 to 33 are identical so that resistances of current paths thereof are substantially the same. Voltage divider 17 comprises three series-connected n transistors whose drains and gates are connected to each other and back gates and sources are also connected to each other between nodes 11 and 13. Divided voltage V2 appears at the connecting point between transistors 31 and 32. For this reason, voltage V2 corresponds to $\frac{2}{3}$ the voltage between VDD and VSS. In voltage divider 17, $\frac{1}{3}$ of the voltage between VDD and VSS is applied to the gate-source regions of transistors 31 to 33. In this case, the sizes of transistors 31–33 are so formed that the gate-source voltage should not exceed three times the gate bias voltage for allowing operation of each transistor 31, 32, or 33 in the weak inversion region.

Figure 5:
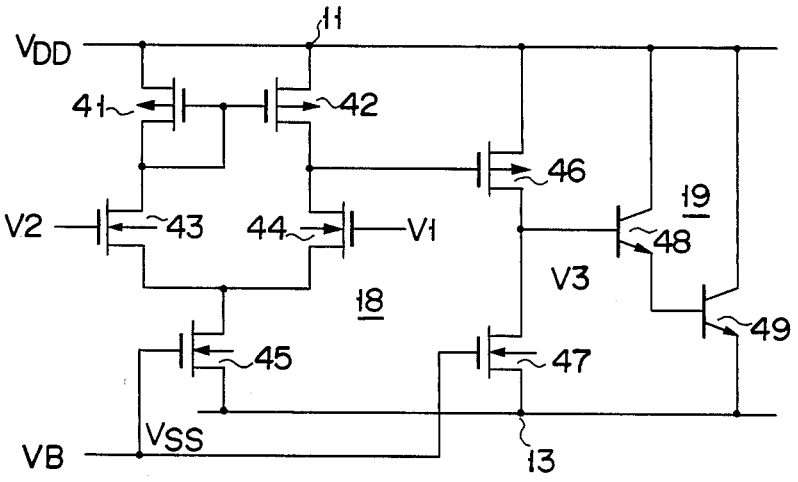

FIG. 5 is a circuit diagram showing the detailed arrangement of comparator 18 and current path circuit 19. Comparator 18 is arranged in a CMOS circuit as follows. The source of p transistor 41 is connected to node 11 applied with voltage VDD. Similarly, the source of p transistor 42 is connected to node 11. The gate and drain of transistor 41 are connected to each other. The gate of p transistor 42 is connected to the gate of transistor 41. Transistors 41 and 42 constitute a current type mirror type load circuit in which a current proportional to a current flowing through transistor 41 is supplied to transistor 42.

The drain of n transistor 43 is connected to the drain of p transistor 41. The drain of n transistor 44 is connected to the drain of transistor 42. The sources of transistors 43 and 44 are connected to each other. The drain of n transistor 45 is connected to the common connecting point of the sources of transistors 43 and 44. The source of transistor 45 is connected to node 13. The gate of transistor 45 is applied with bias voltage VB generated by bias voltage generator 15. The gates of transistors 43 and 44 receive reference voltage V1 generated by reference voltage generator 16 and divided voltage V2 generated by voltage divider 17, respectively. The source of p transistor 46 is connected to node 11. The drain of n transistor 47 is connected to the drain of p transistor 46. The source of transistor 47 is connected to node 13. A voltage appearing at the drain-connecting point between transistors 42 and 44 is supplied to the gate of transistor 46. Bias voltage VB output from generator 15 is applied to the gate of transistor 47. Voltage V3 appears at the drain-connecting point of transistors 46 and 47.

Current path circuit 19 is arranged as follows. The collectors of n-type bipolar transistors 48 and 49 are connected to node 11 applied with voltage VDD. The emitter of transistor 48 is connected to the base of transistor 49, and the emitter of transistor 49 is connected to node 13. In other words, current path circuit 19 constitutes a Darlington circuit consisting of two transistors. Output voltage V3 from comparator 18 is applied to the base of input bipolar transistor 48.

Figure 6:
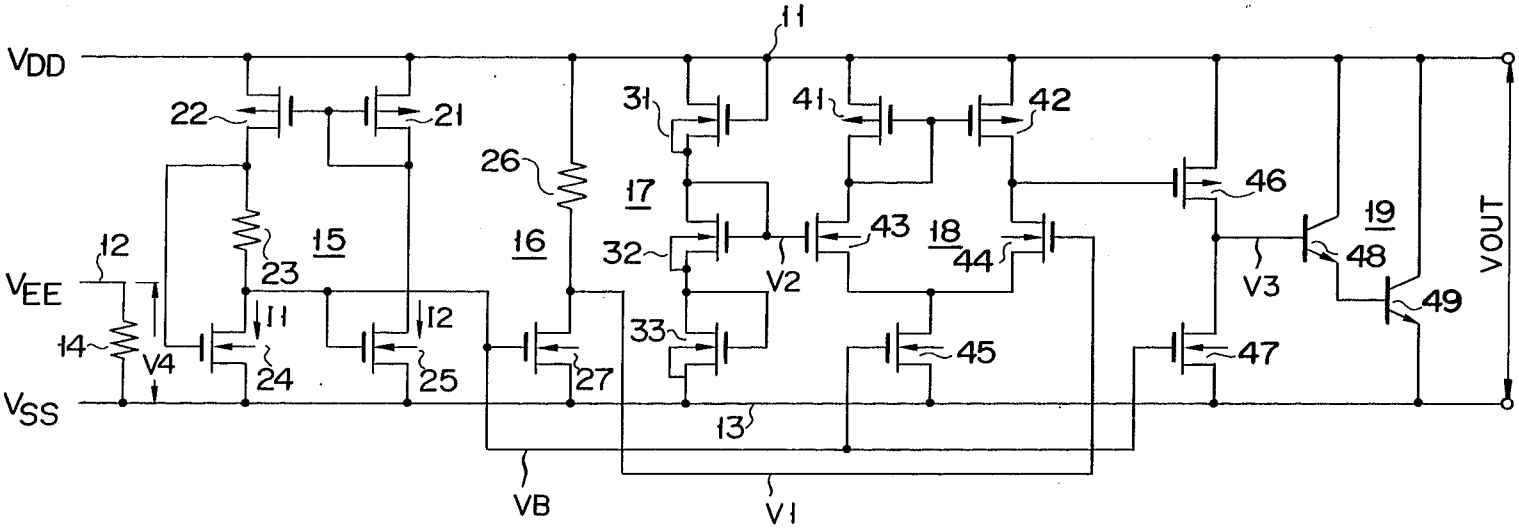
FIG. 6 is a detailed circuit diagram of the embodiment shown in FIG. 1.

FIG. 6 is a circuit diagram obtained by rewriting the circuit of FIG. 1 by using the detailed arrangements of FIGS. 3 to 5. Resistor 14 shown in FIG. 1 is connected between voltages VEE and VSS.

The operation of the circuit having the above-mentioned arrangement will be described in detail.

Figure 7:
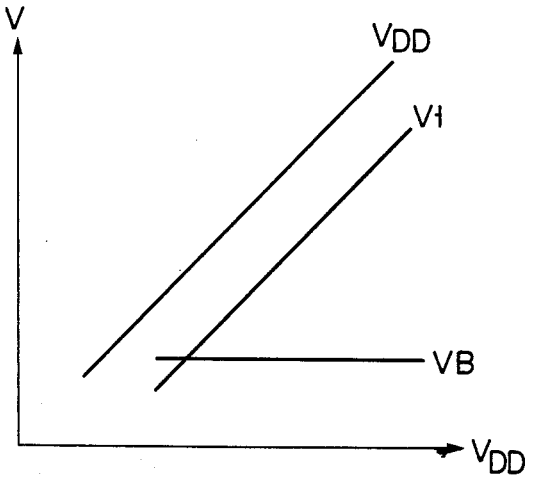
FIG. 7 is a graph showing bias voltage VB and reference voltage V1 as a function of power source voltage VDD.

Assume that current I1 is supplied to transistor 24 in bias voltage generator 15 of FIG. 6. Constant current I2, corresponding to a size ratio of transistors 21 and 22, is supplied to transistor 25. In this case, a voltage corresponding to a threshold voltage of transistor 25 appears at the gate of transistor 25. Since the gate of transistor 27 in reference voltage generator 16 is applied with this voltage as VB, constant current I3 corresponding to a size ratio of transistors 25 and 27 is supplied to transistor 27. Currents I1 and I3 are kept constant even if voltage VDD is changed. A predetermined voltage drop across resistor 26 occurs in generator 16. If the resistance of transistor 26 is given as R1, a voltage drop of $R1 \times I3$ occurs across resistor 26. For this reason, the value of reference voltage V1 is obtained by subtracting the voltage drop component from VDD (i.e., $VDD - R1 \times I3$) FIG. 7 is a graph showing characteristics of voltages VB and V1 with respect to VDD.

A voltage corresponding to $\frac{2}{3}$ the voltage between VDD and VSS is generated as divided voltage V2 by voltage divider 17 shown in FIG. 4.

Figure 8:
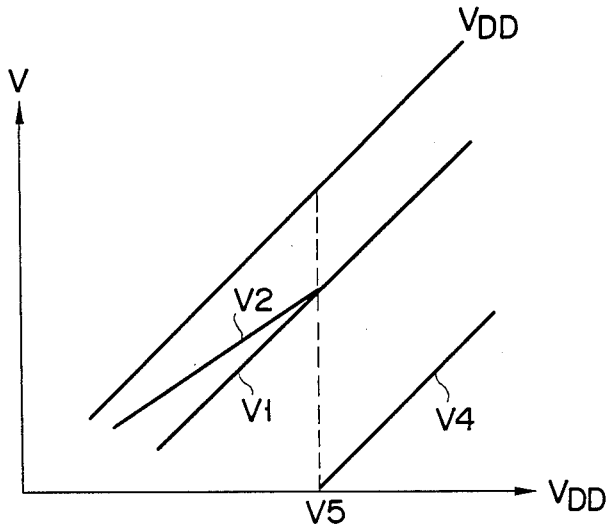
FIG. 8 is a graph showing the output characteristics of the circuits in FIGS. 3 to 5.

In comparator 18 shown in FIG. 6, if divided voltage V2 is higher than reference voltage V1, difference $(V2-V1)$ is amplified by comparator 18 consisting of transistors 41 to 47, and voltage V3 is decreased. The gain in the weak inversion region is very large, as shown in FIG. 2, and voltage V3 is substantially equal to the VSS level. A base current is not supplied to bipolar transistor 19 and hence current path circuit 19. The value of voltage VSS of node 13 is kept constant. However, when voltage VDD is increased and reference voltage V1 exceeds divided voltage V2, difference $(V1-V2)$ is amplified, and voltage V3 is substantially equal to the VDD level or is set in an intermediate level. A base current is supplied to bipolar transistor 48 through transistor 46. When the base current flows in transistor 48, collector currents are supplied to bipolar transistors 48 and 49, thereby causing the current to flow in current path circuit 19. The current supplied to current path circuit 19 is increased in proportion to an increase in VDD, since comparator 18 is operated to increase divided voltage V2 to a value near reference voltage V1 and to cause a potential difference between constant voltage V5 and VDD at resistor 14. For this reason, voltage drop V4 across resistor 14 is increased with the same gradient as that of VDD a voltage V5 obtained at a timing when voltage V1 exceeds voltage V2, as shown in the characteristic curves in FIG. 8. As a result, a voltage corresponding to difference between VDD and V4 is generated between nodes 11 and 13. Since the gradient of the V4 characteristic curve is the same as that of the VDD characteristic curve, a constant voltage is generated between nodes 11 and 13 under the condition wherein VDD is higher than V5.

The circuit constants of bias voltage generator 15 are determined such that transistors 21, 24, and 25 are operated in the weak inversion region. For this reason, these transistors are operated in the weak inversion regions, and thus the current consumption of generator 15 is very low. Since bias voltage VB is applied to the gate of transistor 27 in reference voltage generator 16, transistor 27 is also operated in the weak inversion region. Therefore, the current consumption of reference voltage generator 16 can be minimized.

In addition, since the number of serial stages and voltage V5 are determined to produce gate bias voltages such that the series-connected transistors in voltage divider 17 are operated in weak inversion regions, respectively, current consumption in voltage divider 17 is also minimized. Similarly, since bias voltage VB is applied to the gates of transistors 45 and 47 serving as current sources in comparator 18, and these transistors are operated in the weak inversion region, current consumption in comparator 18 is also minimized.

When all MOS transistors in this embodiment are operated in weak inversion regions, respectively, the total current consumption can be minimized.

Since bipolar transistors are used to constitute current path circuit 19, these transistors having a relatively small size can supply a relatively large current, as compared with the MOS transistors having the identical size. The gradient of the V4 characteristic curve can be near that of the VDD characteristic curve. The value of the limited output voltage can be kept constant. Bipolar transistors 48 and 49 constituting current path circuit 19 can be easily formed as parasitic transistors (FIG. 9) on the semiconductor substrate on which MOS transistors of other circuits are formed.

Figure 9:
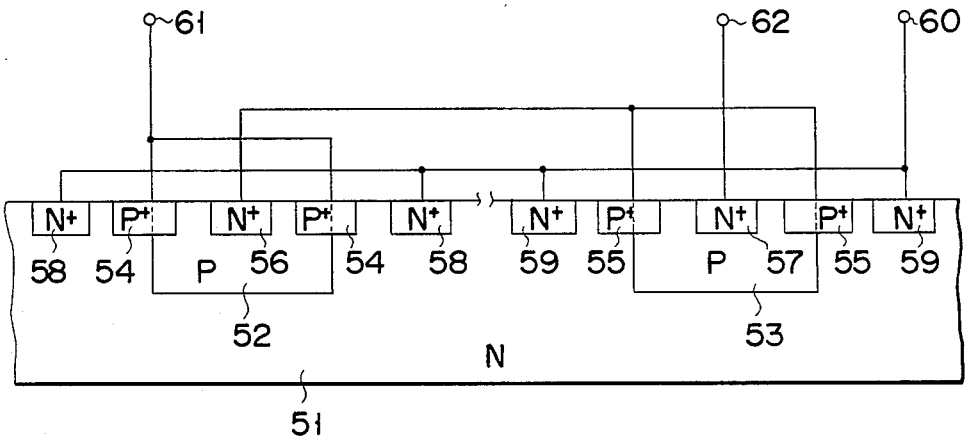
FIG. 9 is a sectional view showing a chip structure of the elements in a current path circuit shown in FIG. 5.

An element structure will be described with reference to the sectional view of FIG. 9 wherein the parasitic transistor comprises the bipolar transistor. Referring to FIG. 9, reference numeral 51 denotes an n-type silicon substrate on which an LSI circuit (not shown) is formed; 52 and 53 are p-type well regions respectively; 54 and 55 are $p^+$-type guard ring regions formed around well regions 52 and 53, respectively; 56 and 57 are $n^+$-type regions formed in well regions 52 and 53, respectively; and 58 and 59 are $n^+$-type regions formed to surround well regions 52 and 53, respectively. Input bipolar transistor 48 in current path circuit 19 is designed such that a collector region is constituted by n-type substrate 51; a collector contact region by $n^+$-type region 58; a base region by p-type well region 52; a base contact region by $p^+$-type guard ring region 54; and an emitter region by $n^+$-type region 56. Similarly, bipolar output transistor 49 is designed such that a collector region is constituted by n-type substrate 51; a collector contact region by $n^+$-type region 59; a base region by p-type well region 53; a base contact region by $p^+$-type guard ring region 55; and an emitter region by $n^+$-type region 57. Regions 58 and 59 are connected to each other and serve as common collector electrode 60. Guard ring region 54 serves as base electrode 61. $N^+$-type region 56 is connected to guard ring region 55, and $n^+$-type region 57 serves as emitter electrode 62.

Figure 10:
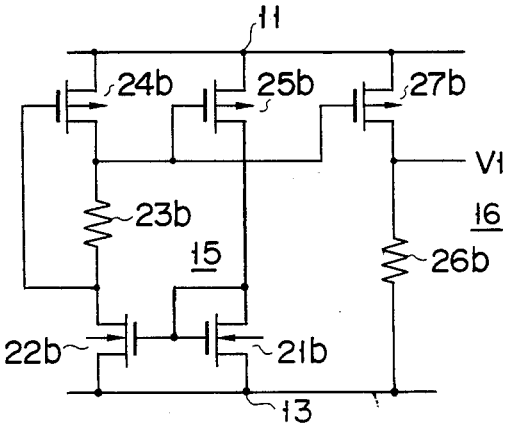
FIGS. 10 to 12 are circuits showing other circuits shown in FIGS. 3 to 5.
Figure 11:
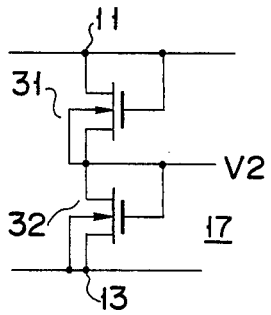
Figure 12:
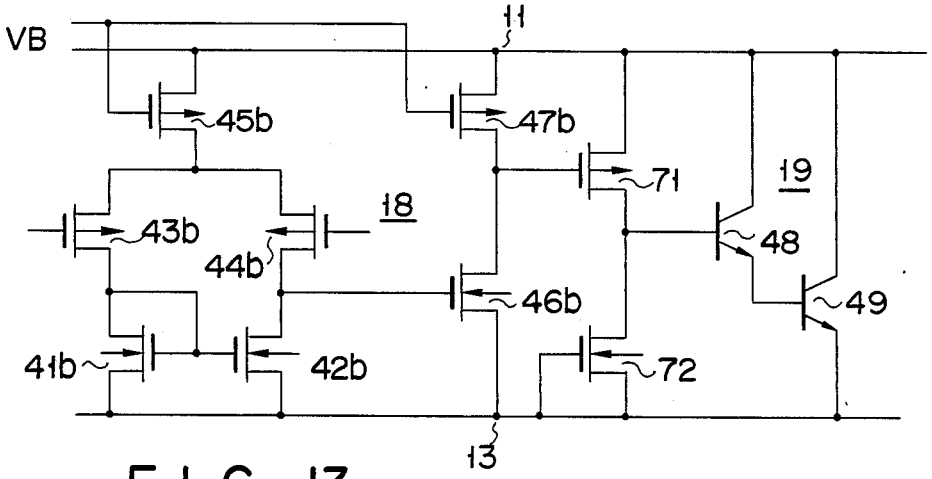

FIGS. 10 to 12 are circuit diagrams showing modifications of the present embodiment.

In these modifications, the conductivity type of MOS transistors in the circuit of FIG. 3 is changed to the one opposite thereto. More particularly, the p-channel in FIG. 3 is changed to the n-channel in FIG. 10. The same reference numerals as in FIG. 3 denote the same parts in FIG. 10 by affixing b to the reference numerals in FIG. 10, and a detailed description thereof will be omitted. In this case, the product of a current flowing through resistor **26*b*** and its resistance corresponds to reference voltage V1.

FIG. 11 shows another modification of voltage divider 17. In this circuit, only two n transistors 31 and 32 are used to obtain a divided voltage. This arrangement can be suitably used when VDD is not high. However, if VDD is high, three or more series-connected MOS transistors must be used to divide voltage VDD.

FIG. 12 shows another arrangement of comparator 18 and current path circuit 19. In this modification, the conductivity type of MOS transistors in FIG. 5 is changed to the one opposite thereto in the same manner as in FIG. 10. More specifically, the p-channel is used in FIG. 5, but the n-channel is used in FIG. 12. The same reference numerals as in FIG. 5 denote the same parts in FIG. 12 by affixing b to the reference numerals, and a detailed description thereof will be omitted. In the circuit of this modification, power source transistor **47*b* is connected to the VDD side, and drive MOS transistor 46*b* is connected to the VSS side. Transistor 46*b* cannot directly drive the bipolar transistor. In this case, an output voltage from comparator 18 is received by inverter 73, consisting of p and n transistors 71 and 72, respectively. Bipolar transistor 48 is driven by an output voltage from inverter 73. In inverter 73, a gate bias voltage applied to transistor 72, serving as a current source, is the gate voltage applied to, e.g., transistor 21*b***.

The voltage limiter according to the present invention can be integrated together with the LSI circuit on a single chip using the substrate of FIG. 9. No components need to be connected to the chip, thus decreasing the fabrication cost. Unlike in the conventional arrangement, the voltage need not be divided by a resistance ratio. In addition, since each MOSFET is designed to be operated in a weak inversion region (below VTH) wherein power consumption is very low, total current consumptoon can be greatly reduced, as compared with the conventional arrangement.

Figure 13:
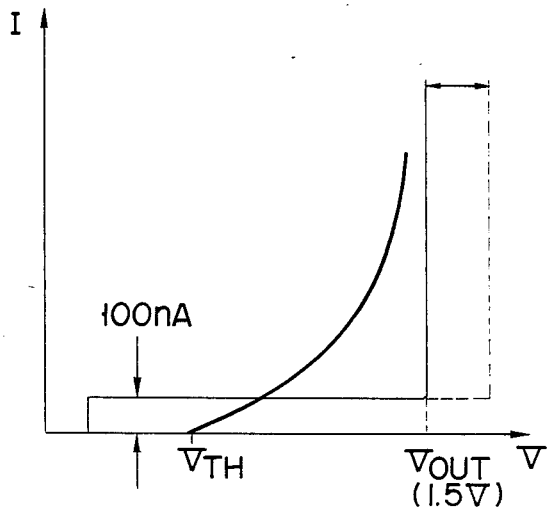
FIG. 13 is a graph showing the operation characteristics of a MOS transistor.

Each MOS transistor requires a minimum current, free from the influence of external or internal noise. The minimum current is a sustaining current of 100 nA in the weak inversion region, as shown in FIG. 13. Such a current of 100 nA is kept constant, regardless of variations in output voltage Vout of the circuit. As shown in FIG. 13, the current of 100 nA is kept constant so as not to shift the operating region of the MOS transistor from the weak inversion region, as shown in FIG. 13. At the same time, regulator output voltage Vout is accurately variable, as indicated by the broken line.

Another embodiment of the present invention will be described in detail with reference to FIGS. 14 to 23B.

Figure 14:
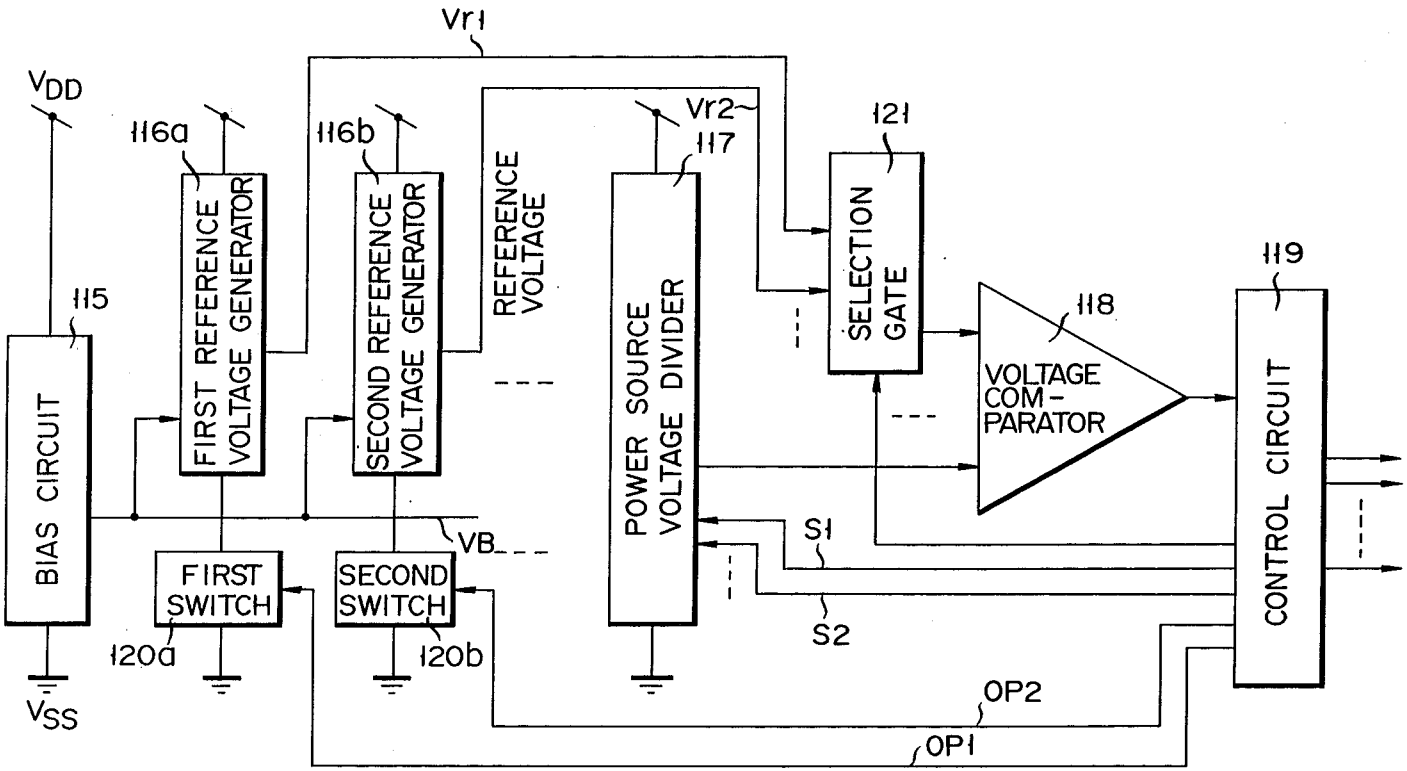
FIG. 14 is a block diagram showing another embodiment according to the present invention.

FIG. 14 shows a power source voltage detector for detecting a multi-value power source level. The power source voltage detector is arranged in an LSI circuit. Reference numeral 117 denotes a power source voltage divider for selecting one of the divided voltages obtained by dividing power source voltage VDD. In this caee, the divided voltage is selected in response to a control signal input supplied from control circuit 119. Reference numeral 115 denotes a bias circuit for generating a bias voltage VB independently of the value of power source voltage VDD. Reference numerals **116*a*, 116*b*, . . . denote a first reference voltage generator, a second reference voltage generator, . . . for receiving the bias voltage VB and generating reference voltages different from each other. These reference voltage generators are controlled by switching circuis 120*a*, 120*b*, . . . , respectively. Reference numeral 121 denotes a selection gate for selecting one of the output voltages (i.e., the plurality of reference voltage outputs) from reference voltage generators 116*a*, 116*b*, . . . in response to a control signal input from control circuit 119. Reference numeral 118 denotes a voltage comparator for comparing the selected output voltage from gate 121 with the divided output voltage from divider 117. Reference numeral 119 denotes a control circuit which receives a switching signal SW and selectively supplies control signals OP1, OP2--- to switching circuits 120*a*, 120*b*,. . . in correspondence with the multi-value power source voltage level to be detected and for supplying control signals S1, S2,--- to voltage divider 117 to extract the predetermined divided output voltage and a control signal for controlling selection operation of gate 121. Control circuit 119 receives an output from voltage comparator 118 as a detection output corresponding to the multi-value power source voltage level to be detected, and outputs selection signals to gate 121** for selecting predetermined reference voltages Vr1, Vr2.

Power source voltage divider 117 is arranged as shown in FIG. 15A or 15B. Referring to FIG. 15A, a plurality (four in this embodiment) of series-connected n-channel MOS transistors T1 to T4 having the same size and having gates and drains connected thereto are connected between the VDD power source terminal and the VSS power source terminal (the ground terminal). N-channel MOS transistor T5, controlled in response to switching control signal S1, is connected between the ground terminal and the common connecting point between transistors T3 and T4. N-channel MOS transistor T6, controlled in response to switching control signal S2, is connected between the ground terminal and the common connecting point between transistors T2 and T3. The divided voltage can be extracted from the common connecting point between transistors T1 and T2. In this case, when transistor T6 is turned on, the divided output voltage is VDD/2 (VSS=0). When transistor T5 is turned on and transistor T6 is turned off, the divided output voltage is 2VDD/3. When both transistors T5 and T6 are turned on, the divided output voltage is 3VDD/4.

In the circuit of FIG. 15B, four n-channel MOS transistors T1 to T4 are connected between the ground terminal and the VDD power source terminal in the same manner as in the circuit of FIG. 15A. Switching control p-channel MOS transistors T7 and T8 are connected between the VDD power source terminal and the common connecting point between transistors T1 and T2 and between the VDD power source terminal and the common connecting point between transistors T2 and T3, respectively. The divided output voltage can be extracted from the common connecting point between transistors T3 and T4. Therefore, when transistor T8 is turned on, the divided output voltage is VDD/2. When transistor T7 is turned on an transistor T8 is turned off, the divided output voltage is VDD/3. When both transistors T7 and T8 are turned off, the divided output voltage is VDD/4.

In each of the circuits shown in FIGS. 15A and 15B, transistors T1 to T4, the gates and drains of which are connected to each other, are operated in the weak inversion regions since, the power source voltage is divided into voltage components which serve as bias voltages, thus greatly decreasing current consumption.

Bias circuit 115 is arranged as shown in FIGS. 16A to 16C to achieve low current consumption, constant current consumption, and a constant voltage output. In the circuit of FIG. 16A, p-channel MOS transistors T9 and T10 constituting a current mirror circuit, resistor R, and n-channel MOS transistors T11 and T12 are connected in an illustrated manner. In the circuit of FIG. 16B, p-channel MOS transistors T13 and T14, resistor R, and n-channel MOS transistors T15 and T16 constituting a current mirror circuit are connected in an illustrated manner. In the circuit of FIG. 16C, p-channel MOS transistors T17 and T18, n-channel MOS transistors T19 and T20 constituting a current mirror circuit, and resistor R are connected in an illustrated manner. In the circuit of FIG. 16D, resistor R, p-channel MOS transistors T21 and T22 constituting a current mirror circuit, and n-channel MOS transistors T23 and T24 constituting another current mirror circuit are connected in an illustrated manner.

Figure 17A:
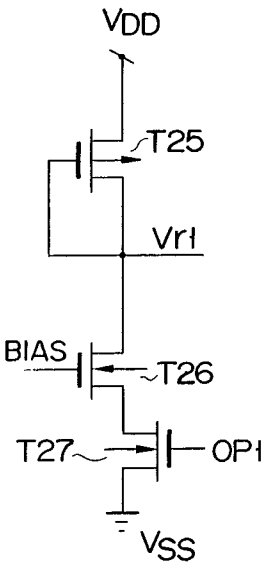
Figure 17B:
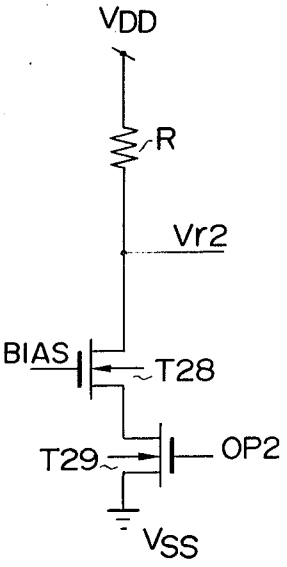
Figure 17C:
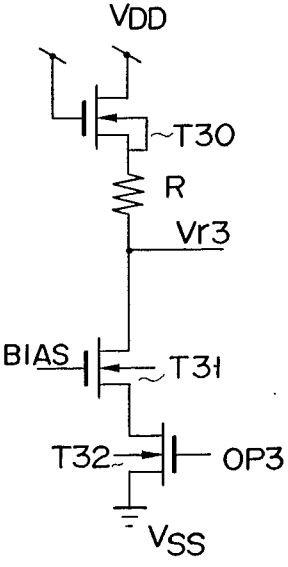
Figure 17D:
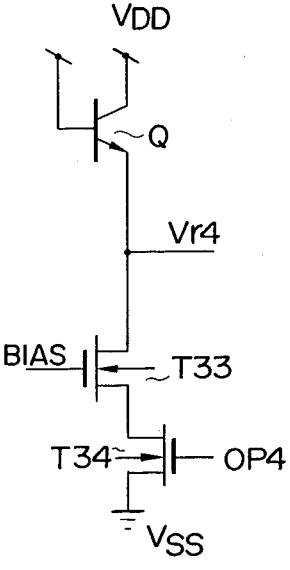

A combination of reference voltage generators 116*a*, 116*b*, . . . and switching circuits 120*a*, 120*b*, . . . is arranged as shown in FIGS. 17A to 17D to easily set reference voltages Vr1 to Vr4 according to the magnitudes of the bias voltage inputs and to stop the circuit operations in response to switching control inputs OP1 to OP4. More specifically, in the circuit of FIG. 17A, p-channel MOS transistor T25 whose gate and drain are connected to each other, bias input n-channel MOS transistor T26, and switching control signal input n-channel MOS transistor T27 are connected in series with each other. Reference voltage Vr1 is generated utilizing the gate threshold voltage of transistor T25. In the circuit of FIG. 17B, resistor R, bias input n-channel MOS transistor T28, and switching input n-channel MOS transistor T29 are connected in series with each other. Reference voltage Vr2 is generated utilizing a voltage drop across resistor R. In the circuit of FIG. 17C, n-channel transistor T30 whose gate and drain are connected to each other, resistor R, bias input n-channel MOS transistor T31, and switching control input n-channel MOS transistor T32 are connected in series with each other. Reference voltage Vr3 is generated utilizing the gate threshold voltage of transistor T30 and a voltage drop across resistor R. In the circuit of FIG. 17D, npn transistor Q whose base and collector are connected to each other, bias input n-channel MOS transistor T33, and switching control input MOS transistor T34 are connected in series with each other. Reference voltage Vr4 can be generated utilizing the base-emitter voltage of transistor Q.

In the circuit of FIG. 17D, npn transistor Q as a resistive element comprises a parasitic bipolar transistor prepared in the CMOS structure. The parasitic bipolar transistor has advantages in that influences of characteristic varaations in the MOS process are small and the pattern area is small. The LSI fabrication cost is not increased since such a transistor can be formed on the chip without changing the MOS LSI fabrication process.

Figure 18:
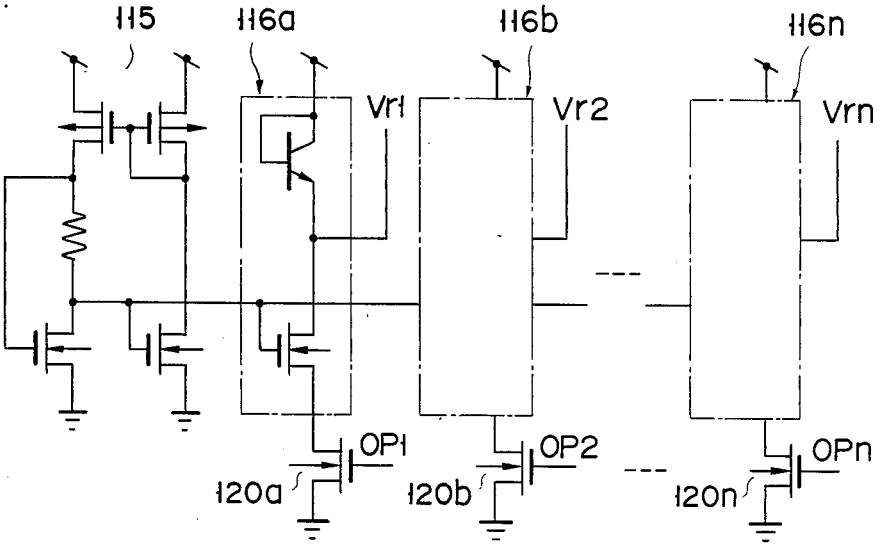
Figure 19:
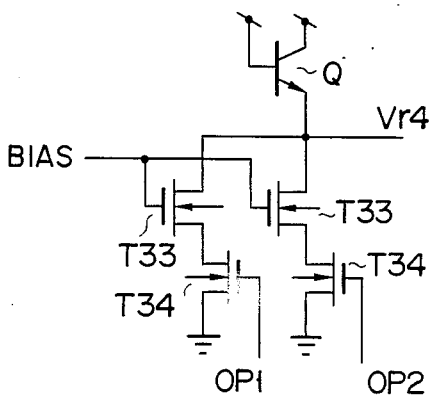

FIG. 18 shows part of the power source voltage detector when the circuit of FIG. 16A is employed as bias circuit 115 and the circuit (FIG. 17D) having different circuit constants is employed as a combination of reference voltage generators 116*a*, 116*b*, . . . and switching circuits 120*a*, 120*b*, . . . . Another arrangement (FIG. 19) of the power source voltage detector may be obtained such that a plurality (two, in this case) of series circuits each having bias input transistor T33 (T33*a* and T33*b*) and switching control input transistor T34 (T34*a* and T34*b*) in FIG. 17D may be connected in parallel with each other. In this case, the constants of bias input transistors T33 (T33*a* and T33*b*) in the individual series circuits must differ from each other.

Figure 20A:
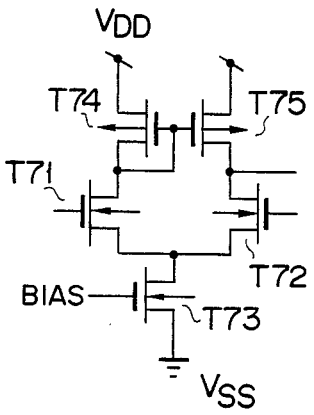
Figure 20B:
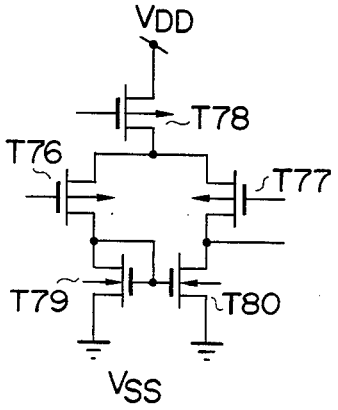

Voltage comparator 118 may be arranged by using a MOS transistor differential amplifier shown in FIG. 20A or 20B. The amplifier in FIG. 20A comprises differential amplifier n-channel MOS transistors T71 and T72, constant current source n-channel MOS transistor T73 applied with a bias voltage at its gate, and load p-channel MOS transistors T74 and T75 constituting a current mirror circuit. The amplifier in FIG. 20B comprises differential amplifier p-channel MOS transistors T76 and T77, constant current source p-channel MOS transistor T78 applied with a bias voltage at its gate, and load n-channel MOS transistors T79 and T80 constituting a current mirror circuit. In each amplifier of FIG. 20A or 20B, the bias voltage VB from the bias circuit (115 in FIG. 14) can be used without modifications, thus achieving the operation with low current consumption.

The operation for selectively detecting the multi-value power source levels in the power source voltage detector will be described below. When control circuit 119 selectively controls switching circuits 120*a*, 120*b*, . . . , a corresponding one of reference voltage generators 116*a*, 116*b*, . . . is operated and a corresponding one of reference voltages Vr1, Vr2, . . . is generated. The selected reference voltage is gated by selection gate 121 controlled by control circuit 119 and is supplied to one input terminal of voltage comparator 118. Power source voltage divider 117 generates divided voltage Vdiv under the control of control circuit 119. Voltage Vdiv is applied to the other input terminal of voltage comparator 118. Assume that power source voltage VDD generated from a solar cell varies for some reason. The relationship between the magnitudes of the reference and divided output voltages selected for one power source level among the multi-value power source levels) subjected to detection is changed, and this change is detected by voltage comparator 118. Comparator 118 supplies to control circuit 119 a detection signal representing that the power source level subjected to detection has been detected. Control circuit 119 selects the corresponding pair of reference and divided output voltages, thereby selecting any one of the multi-value power source levels.

In the above operation, selection gate 121 and control circuit 119 are digitally operated and have low current consumption. Gate 121 and control circuit 119 can be arranged using MOS transistors as minimum elements on the chip and have the small pattern area.

According to the power source voltage detector of the above embodiment, the plurality of reference voltage generators having different circuit constants for detecting the multi-value power source levels can be selectively controlled. At the same time, one of the plurality of divided output voltages from one power source voltage divider can be generated. The constant voltage bias circuit, the voltage comparator, and the control circuit are commonly used to detect multi-value levels. An unnecessary redundancy circuit need not be used. When the detector is incorporated in the LSI, the pattern area on the chip can be small and power consumption is constant and small. It is also possible to change the detection level according to the sequential behavior of the power source levels, thus increasing the design margin for multi-value level detection.

In the above embodiment, the plurality of reference voltage generators are selectively controlled in response to a control signal, and power source voltage division operation of one power source voltage divider is controlled. However, the plurality of power source voltage dividers (that generate different divided output voltages) may be controlled in response to the control signal, and reference voltage generation of one reference voltage generator (the generator selectively generates one of different reference voltages each time) may be controlled.

Figure 21:
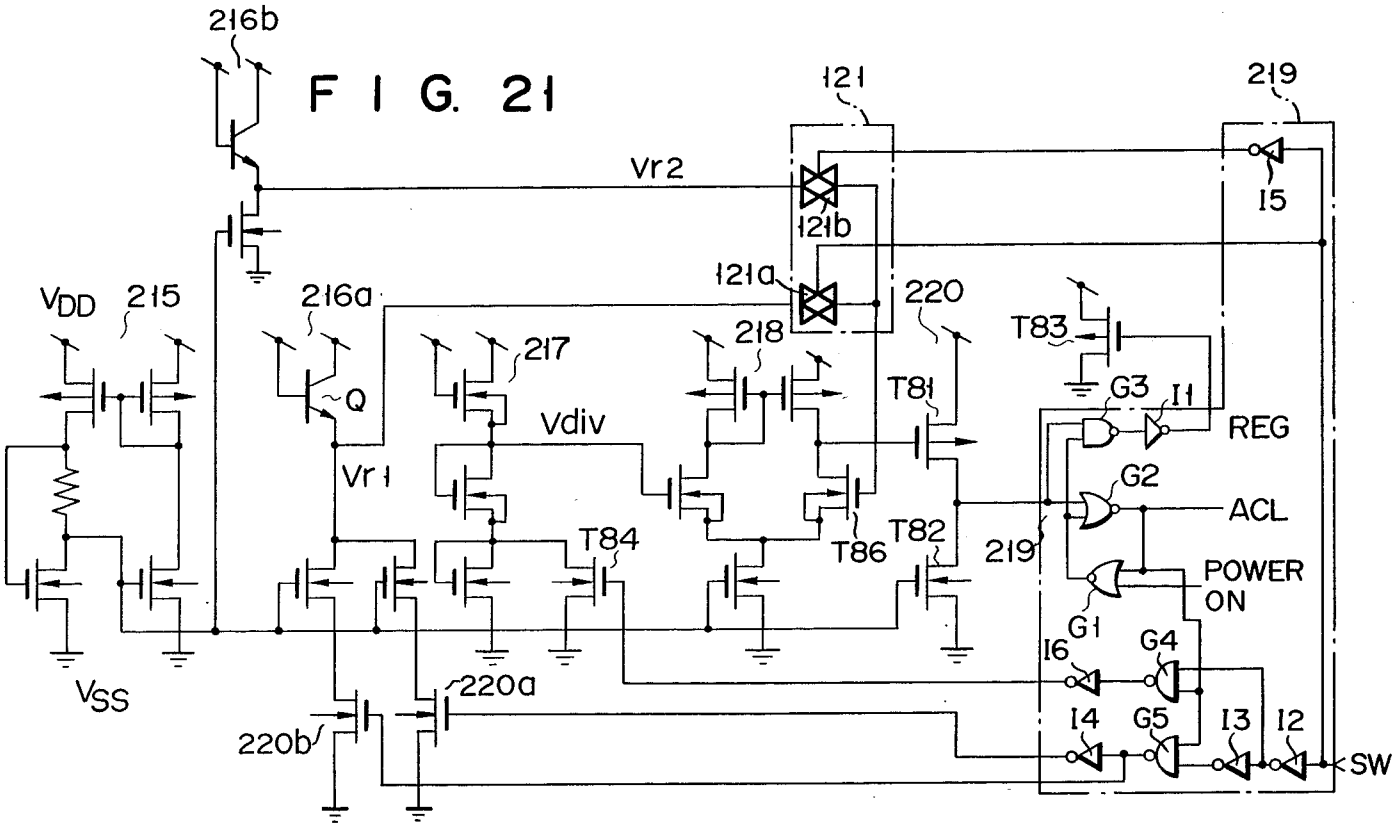
FIG. 21 is a circuit diagram showing an application of the embodiment shown in FIG. 14.

A power source voltage detector used in an LSI circuit (e.g., an electronic desk-top calculator LSI) having a power source such as a solar cell whose power source voltage varies will be described with reference to FIG. 21 in the embodiment of FIG. 14 according to the present invention. Referring to FIG. 21, reference numeral 217 denotes a power source voltage divider for selectively outputting binary divided output voltage Vdiv in response to a control signal from control circuit 219; 215, a bias circuit; 216*a* and 216*b*, reference voltage generators for generating reference voltages Vr1, Vr2; and 218, a voltage comparator for comparing the voltage Vdiv with voltage Vr1 or Vr2. Reference numeral 220 denotes a buffer circuit. In buffer circuit 220, p-channel MOS transistor T81 connected between the ground terminal and the VDD power source terminal is connected in series with bias input n-channel MOS transistor T82. An output from voltage comparator 218 is supplied to the gate of transistor T81. Control circuit 219 comprises: first 2-input NOR gate G1 for receiving a power-on signal at one input terminal thereof when the LSI power switch is turned on and auto clear signal ACL at the other input terminal; second 2-input NOR gate G2 for receiving an output from NOR gate G1 at one input terminal thereof and an output from buffer ciruit 220 at the other input terminal thereof for outputting the auto clear signal ACL; 2-input NAND gate G3 for receiving an output from NOR gate G1 and the output from buffer circuit 220 for outputting a regulating signal REG; inverter I1 for receiving an output from NAND gate G3; a NAND gate G4 for receiving an output from NOR gate G2 and an inverted switching signal SW from an inverter I2. An output from NAND gate G4 is supplied to the gate terminal of transistor T84 via an inverter I6. The output from inverter I2 is also supplied to one input of NAND gate G5 via an inverter I3 and the signal ACL is supplied to the other input of NAND gate G5. Output of NAND gate G5 is supplied to the switching transistor 220*a* via an inverter I4 and supplied directly to the switching transistor 220*b*. Switching signal SW is also supplied to control terminals of controlled switching elements 121*a*, 121*b* directly and via in inverter I5, respectively. Output of element 121*a* or 121*b* is selectively supplied to transistor T86. When signal from NAND gate G4 is set at low level, voltage divider 217 generates output Vdiv of 2VDD/3. However, if signal supplied to transistor T84 is set at high level, divider 217 generates output Vdiv of VDD/2. Reference numeral T83 denotes a current path n-channel MOS transistor connected between the ground terminal and the VDD power source terminal. The output from inverter I1 is applied to the gate of transistor T83.

In FIG. 21, when switching signal SW is "0", switching element 121*a* is turned on and element 121*b* is turned off, so that reference voltage Vr1 is supplied to the gate of transistor T86 and is compared with the divided voltage Vdiv.

Since the switching signal SW is "0", one input of the NAND gate G4 is "1", and that of NAND gate G5 is "0". Therefore, when POWER ON signal "1" and auto clear signal ACL of "0" are supplied, "0" and "1" outputs are obtained from gates G4 and G5, respectively. As a result, transistor T84 is turned on and transistor 220*a* is maintained in "OFF" state and transistor 220*b* is turned on.

Figure 22:
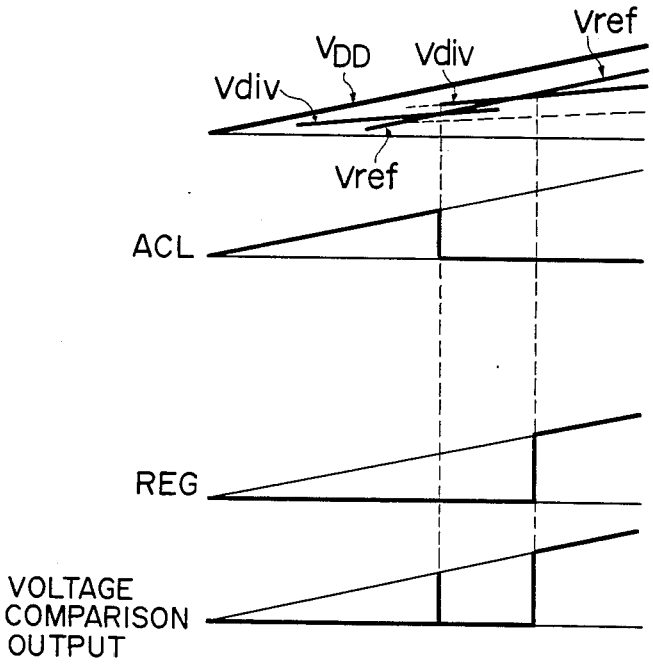
FIG. 22 is a chart for explaining the operation of the circuit in FIG. 21.

The operation of the LSI power source voltage detector using the solar cell as a power source will be described with reference to FIG. 22. When the power switch of the solar cell is turned on, the power on signal "1" is input to first NOR gate G1. When the power source voltage of the solar cell is increased according to an increase in intensity of incident light, an output (auto clear signal ACL) from second NOR gate G2 is gradually increased. In this case, reference voltage generator 216*a* generates reference voltage Vr1 lower than the VDD potential by a base-emitter voltage (e.g., 0.5 V) of transistor Q. An output from inverter I6 is set at "1" level, and power source voltage divider 217 generates Vdiv=VDD/2. If Vr1>VDD/2 (e.g., 1.0 V), the output voltage of voltage comparator 218 is decreased, and an output potential of buffer circuit 220 is increased. Output ACL from second NOR gate G2 goes level "1", and output from inverter I6 is decreased. In this case, transistor T84 is turned off and power source voltage divider 217 generates 2VDD/3. An output from voltage comparator 218 represents relation Vr1<2VDD/3 and is thus increased, while an output from buffer circuit 220 is decreased. In this condition, when an illuminance of light incident on the solar cell is further increased and satisfies relation Vr1>2VDD/3 (e.g., 1.5 V), an output voltage from voltage comparator 218 is decreased, while an output voltage from buffer circuit 220 is increased. In this case, an output from first NOR gate G1 is set at a low level, and two inputs to NAND gate G3 are set at "1" and "0" levels. An output REG from inverter I1 is then set at a high level. A current (about several hundreds of $\mu$A to about several mA) is supplied to current path n-channel transistor T83, and then an excessive voltage generated by the solar cell is limited. Even if the level of the voltage generated by the solar cell varies, a constant voltage suitable for the LSI operation can be supplied. Current path transistor T83 is preferably constituted by a Darlington-connected bipolar transistor because of its current drive capacity. With this arrangement, however, the current drive level tends to vary due to variations in current gain hfe. In this sense, a MOS transistor can be easily used to stabilize the electrical characteristics. In the embodiment of FIG. 21, a ratio of channel width W to length L of all transistors excluding transistor T83 falls within the range of $1/10<W/L<20$.

In the power source voltage detector according to the above embodiment, the circuit arrangement for detecting the multi-value power source voltage levels can be simplified, and the circuit pattern area of the detector on the semiconductor IC is small. In addition, the detector requires low current consumption and provides versatility, e.g., sequential detection of multi-value levels. Therefore, the power source voltage detector can be effectively applied to an LSI having a solar cell as a power source.

Figure 23:
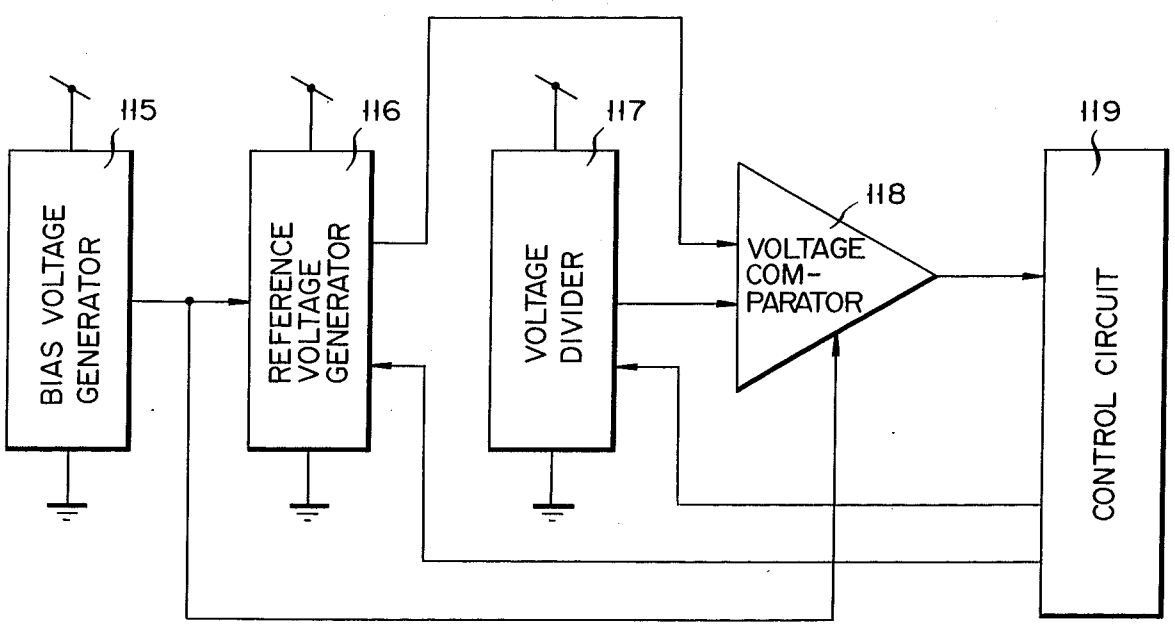
FIG. 23 is a block diagram showing still another embodiment of the present invention.

FIG. 23 shows a modification of the embodiment shown in FIG. 14. Unlike in the arrangement of FIG. 14, single reference voltage generator 116 is used in the circuit of FIG. 23 in place of the plurality of reference voltage voltage generators 116*a*, 116*b*,. . . , and switches 120*a*, 120*b*, . . . are omitted to simplify the circuit arrangement. The same reference numerals as in FIG. 14 denote the same parts in FIG. 23, and a detailed description thereof will be omitted.

Reference voltage generator 116 in FIG. 23 has a detailed arrangement shown in FIG. 24. One of a plurality of switches SW1, . . . SWn is turned on to obtain the same output OUT as in the plurality of reference voltage generators 116*a*, 116*b*, . . . in FIG. 14. A plurality of parallel circuits consisting of switches SW1 to SWn and MOS transistors T101-1, T101-2, . . . T101-*n* are connected between the emitter of bipolar transistor T100 and voltage VSS.

As shown in FIG. 25A, the conventional MOS transistor has source S, drain D, and gate G. However, switches SW1 to SWn are arranged in identical transistor formation regions. As shown in FIG. 25B, impurity-doped region Im is formed between source S and drain D to constitute a switch ON structure. The region which is not doped with an impurity constitutes a switch OFF structure, as shown in FIG. 25C. In this manner, selection of output OUT can be specified during the LSI fabrication process.

Figure 26:
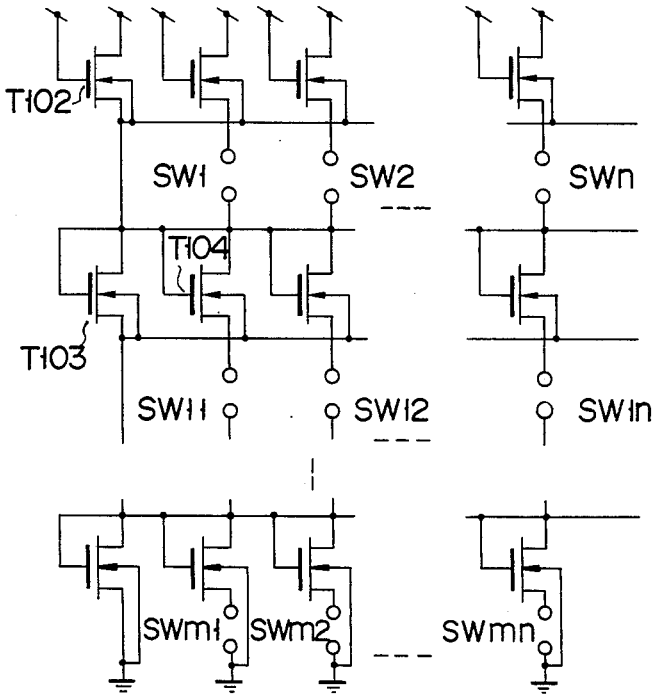
FIG. 26 is a circuit diagram showing an application of a voltage divider.

Voltage divider 117 may have an arrangement as shown in FIG. 26. Switches SW1 to SWn and SW11 to SW1*n* are selectively turned on to obtain a larger number of voltage division ratios than the number of voltage division ratios of $\frac{1}{2}$, $\frac{1}{3}$, $\frac{3}{4}$, . . . .

Referring to FIG. 26, for example, if only switch SW11 is turned on, a voltage division ratio determined by transistors T102 and T103 apparently differs from that of transistors T103 and T104 due to parallel connections.

Figure 27A:
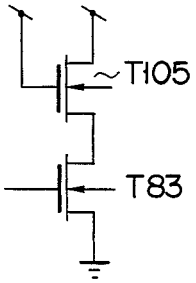
FIGS. 27A to 27C are circuit diagrams showing applications of the current path.
Figure 27B:
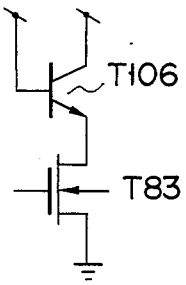
Figure 27C:
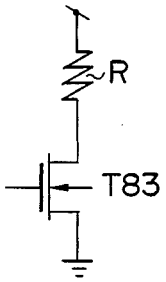

Arrangements shown in FIGS. 27A to 27C can be used in place of current path transistor T83 of FIG. 21. In the arrangement of FIG. 27A, diode-connected MOS transistor T105 is connected in series with transistor T83. In the arrangement of FIG. 27B, bipolar transistor T106 is connected to a diode. In the arrangement of FIG. 27C, resistor R is connected to transistor T83. These arrangements aim at limiting a current flowing through transistor T83.

What is claimed is:

1. A voltage regulating circuit comprising:

a first node applied with a first power source voltage;

a second node applied with a second power source voltage;

a third node connected to said second node through a first resistive element;

bias voltage generating means, inserted between said first and third nodes, for generating a predetermined bias voltage, said bias voltage generating means comprising:

a first MOS transistor of a first conductive type channel, a source of which is connected to said first node, a second MOS transistor of the first conductive type channel, a source of which is connected to said first node, a gate of which is connected to a gate of said first MOS transistor, said gate of said second MOS transistor being connected to a drain thereof, a resistor having one end connected to a drain of said first MOS transistor, a third MOS transistor of a second conductive type channel, a drain of which is connected to said third node, a source of which is connected to the other terminal of said resistor, and a gate of which is connected to one end of said resistor, and a fourth MOS transistor of the second conductive type channel, a source of which is connected to said second node, a drain of which is connected to said drain of said first MOS transistor, and a gate of which is connected to the other terminal of said resistor;

reference voltage generating means for generating a reference voltage, said reference voltage generating means being arranged such that a second resistive element and a fifth MOS transistor having a gate applied with the predetermined bias voltage generated by said bias voltage generating means are inserted in series between said first and third nodes;

voltage dividing means for dividing a voltage between said first and third nodes, to output a divided output voltage, said voltage dividing means being arranged such that a plurality of MOS transistors are inserted in series between said first and third nodes;

voltage comparing means, arranged between said first and third nodes, for comparing the reference voltage with the divided output voltage output from said voltage dividing means; and current path means including at least a bipolar transistor, a collector-emitter path of which is inserted between said first and third nodes and a base of which receives an output from said voltage comparing means for limiting a current flowing through said first resistive element so as to generate a predetermined voltage drop across the first resistive element;

wherein a voltage applied across the first and second nodes is regulated and a predetemined voltage appears between said first and third nodes.

2. A power source voltage detector circuit arranged in a semiconductor integrated circuit, comprising:

a bias circuit, arranged in said semiconductor integrated circuit, for generating a constant bias voltage;

a reference voltage generator adapted to generate a plurality of reference voltages upon reception of the bias voltage from said bias circuit;

a power source voltage divider adapted to generate a plurality of divided voltages and to control the magnitudes of said plurality of divided voltages in response to a control signal;

a voltage comparator for comparing one of the plurality of divided voltages generated by said power source voltage divider with one of the plurality of reference voltages generated by said reference voltage generator; and a control circuit for controlling, by said control signal, at least one of said reference voltage generator and said power source voltage divider for outputting at least one of said plurality of reference voltages and said plurality of divided voltages.

3. A voltage regulating circuit comprising:

a first node applied with a first power source voltage;

a second node applied with a second power source voltage;

a third node connected to said second node through a first resistive element;

bias voltage generating means, inserted between said first and third nodes, for generating a predetermined bias voltage;

reference voltage generating means for generating a reference voltage, said reference voltage generating means being arranged such that a second resistive element and a first M0S transistor having a gate applied with the predetermined bias voltage generated by said bias voltage generating means are inserted in series between said first and third nodes;

voltage dividing means for dividing a voltage between said first and third nodes, to output a divided output voltage, said voltage dividing means being arranged such that a plurality of MOS transistors are inserted in series between said first and third nodes, said plurality of MOS transistors being arranged such that gates thereof are connected to drains thereof and that sources thereof are connected to back gates thereof;

voltage comparing means, arranged between said first and third nodes, for comparing the reference voltage with the divided output voltage output from said voltage dividing means; and current path means including at least a bipolar transistor, a collector-emitter path of which is inserted between said first and third nodes and a base of which receives an output from said voltage comparing means for limiting a current flowing through said first resistive element so as to generate a predetermined voltage drop across the first resistive element;

wherein a voltage applied across the first and second nodes is regulated and a predetermined voltage appears between said first and third nodes.

4. A voltage regulating circuit comprising:

a first node applied with a first power soucce voltage;

a second node applied with a second power source voltage;

a third node connected to said second node through a first resistive element;

bias voltage generating means, inserted between said first and third nodes, for generating a predetermined bias voltage;

reference voltage generating means for generating a reference voltage, said reference voltage generating means being arranged such that a second resistive element and a first MOS transistor having a gate applied with the predetermined bias voltage generated by said bias voltage generating means are inserted in series between said first and third nodes;

voltage dividing means for dividing a voltage between said first and third nodes, to output a divided output voltage, said voltage dividing means being arranged such that a plurality of MOS transistors are inserted in series between said first and third nodes;

voltage comparing means, arranged between said first and third nodes, for comparing the reference voltage with the divided output voltage output from said voltage dividing means, said voltage comparing means comprising:

a second MOS transistor of a first conductive type channel, a source of which is connected to said first node and a drain of which is connected to a gate thereof, a third MOS transistor of the first conductive type chanel, a source of which is connected to said second node and a gate of which is connected to said gate of said second MOS transistor, a fourth MOS transistor of a second conductive type channel, a drain of which is connected to a drain of said second MOS transistor and a gate of which is applied with the divided output voltage, a fifth MOS transistor of the second conductive type channel, a drain of which is connected to a drain of said third MOS transistor, a source of which is connected to a source of said fourth MOS transistor, and a gate of which is applied with the reference voltage, a sixth MOS transistor of the second conductive type channel, a source of which is connected to said third node, a drain of which is connected to a common source connecting point of said fourth and fifth MOS transistors, and a gate of which is applied with the predetermined bias voltage generated by said bias voltage generating means, a seventh MOS transistor of the first conductive type channel, a source of which is connected to said first node and a gate of which is connected to said drain of said third MOS transistor, and an eighth MOS transistor of the second conductive type channel, a drain of which is connected to said drain of said seventh MOS transistor, a source of which is connected to said second node, and a gate of which is applied with the predetermined bias voltage generated by said bias voltage generating means, wherein a regulated output voltage appears at a connecting point between said seventh and eight MOS transistors; and current path means including at least a bipolar transistor, a collector-emitter path of which is inserted between said first and third nodes and a base of which receives an output from said voltage comparing means for limiting a current flowing through said first resistive element so as to generate a predetermined voltage drop across the first resistive element;

wherein a voltage applied across the first and second nodes is regulated and a predetermined voltage appears between said first and third nodes.

5. A voltage regulating circuit comprising:

a first node applied with a first power source voltage;

a second node applied with a second power source voltage;

a third node connected to said second node through a first resistive element;

bias voltage generating means, inserted between said first and third nodes, for generating a predetermined bias voltage;

reference voltage generating means for generating a reference voltage, said reference voltage generating means being arranged such that a second resistive element and a first MOS transistor having a gate applied with the predetermined bias voltage generated by said bias voltage generating means are inserted in series between said first and third nodes;

voltage dividing means for dividing a voltage between said first and third nodes, to output a divided output voltage, said voltage dividing means being arranged such that a plurality of MOS transistors are inserted in series between said first and third nodes;

voltage comparing means, arranged between said first and third nodes, for comparing the reference voltage with the divided output voltage output from said voltage dividing means; and current path means comprising a Darlington transistor circuit, the collector-emitter path of which is inserted between said first and third nodes and the base of which receives an output from said voltage comparing means for limiting a current flowing through said first resistive element so as to generate a predetermined voltage drop across the first resistive element;

wherein a voltage applied across the first and second nodes is regulated and a predetermined voltage appears between said first and third nodes.

* * * * *